US008455407B2

(12) United States Patent
Schmidt-Amelunxen et al.

(10) Patent No.: US 8,455,407 B2
(45) Date of Patent: Jun. 4, 2013

(54) LUBRICATING GREASE COMPOSITION BASED ON IONIC LIQUIDS

(75) Inventors: Martin Schmidt-Amelunxen, Röhrmoos/Arzbach (DE); Dieter Sohn, Greifenberg/Ammersee (DE); Stefan Grundei, Mering (DE); Andrea Höpke, Olching (DE)

(73) Assignee: Kluber Lubrication Munchen KG, Munich (DE)

( * ) Notice: Subject to any disclaimer, the term of this patent is extended or adjusted under 35 U.S.C. 154(b) by 225 days.

(21) Appl. No.: 12/736,385

(22) PCT Filed: Mar. 19, 2009

(86) PCT No.: PCT/EP2009/002051

§ 371 (c)(1), (2), (4) Date: Dec. 22, 2010

(87) PCT Pub. No.: WO2009/121494

PCT Pub. Date: Oct. 8, 2009

(65) Prior Publication Data

US 2011/0092399 A1 Apr. 21, 2011

(30) Foreign Application Priority Data

Apr. 4, 2008 (DE) ..... 10 2008 017 144

(51) Int. Cl.
*C10M 169/04* (2006.01)
*C09G 3/00* (2006.01)

(52) U.S. Cl.
USPC ..... 508/128; 508/590

(58) Field of Classification Search
USPC ..... 508/192, 590
See application file for complete search history.

(56) References Cited

FOREIGN PATENT DOCUMENTS

JP 2007 231987 * 9/2007

* cited by examiner

*Primary Examiner* — Prem C Singh
*Assistant Examiner* — Francis C Campanell
(74) *Attorney, Agent, or Firm* — Kubovcik & Kubovcik

(57) ABSTRACT

The invention relates to the use of ionic liquids for production of water-resistant lubricating grease compositions, which are used in a temperature range from at least 30° C. to at least 180° C. and have good anticorrosion properties.

23 Claims, No Drawings

LUBRICATING GREASE COMPOSITION BASED ON IONIC LIQUIDS

This application is a 371 of international application PCT/EP2009/002051, filed Mar. 19, 2009, which claims priority based on German patent application No. 10 2008 017 144.1 filed Apr. 4, 2008, which is incorporated herein by reference.

The invention relates to a lubricating grease composition based on ionic liquids for protective treatment of components used in the automotive field, in wind power plants and in processing machines and working machines, where they are exposed to constant contact with water. The invention relates in particular to a water-resistant lubricating grease composition used in a temperature range from at least −30° C. to at least 180° C. to protect components provided with this lubricant from oxidation and corrosion.

The development of novel lubricating grease compositions must be associated with the general further development of the technology, which makes new and higher requirements of the lubricating grease compositions. The known compositions no longer meet these requirements. In particular when the operating fluids are used in processing machines and working machines, these requirements are enormous from the standpoint of the extreme operating conditions such as high and low temperatures, high rotational speeds.

The use of ionic liquids in lubrication technology, hereinafter referred to as IL (=ionic liquid), has been investigated extensively in recent years. Ionic liquids are defined as materials comprised of cations and anions and having melting points below 100° C. Many ILs have much a lower melting point, so they are present as liquids at room temperature, hereinafter referred to as RTIL (=room temperature ionic liquids). RTILs are of special interest as base oils in particular in the field of tribology, because salt-like compounds have especially low evaporation or none at all as long as they do not undergo a chemical change due to decomposition processes. Ionic liquids have an extremely low vapor pressure, are non-flammable and are often thermally stable to temperatures above 260° C. and are also still capable of lubricating.

Chenggeng Ye, Weimin Liu, Yunxiz Chen, Laigui Yu (Chem. Commun. 2001, 2244-2245) presented friction and wear investigations of ionic liquids. Tribological investigations have been conducted using 1-methyl-3-hexylimidazolium tetrafluoroborate and 1-ethyl-3-hexylimidazolium tetrafluoroborate. It has been found that the compounds investigated show a good reduction in friction, good antiwear properties and a high load-bearing capacity.

Japanese Patent Application No. 2005-185718 describes a lubricating grease composition containing as the basic grease a mixture of an ionic liquid, a thickener and additional additives. This lubricating grease is used for roller bearings or ball bearings.

Japanese Patent Application No. 2005-112597 discloses a lubricating grease composition, which is used in electronic devices and contains an ionic liquid as the base oil and a thickener having a pour point of 260° C.

Japanese Patent Application No. 2003-376010 relates to a semisolid lubricating grease composition containing an ionic liquid and a thickener as part of a base oil. This lubricating grease composition is suitable for applications in vacuo.

Japanese Patent Application No. 2005-197958 relates to a lubricating grease composition for roller bearing machines containing an ionic liquid as part of a base oil.

Japanese Patent Application No. 2005-294405 describes an electrically conductive bearing grease used in a printer or copier and consisting of a carbon-based thickener and a base oil containing an ionic liquid.

The publications cited above thus propose greases which are supposed to be suitable for conducting electric currents, for use at high temperatures and/or in vacuo.

The known lubricating grease compositions described above have the following disadvantages from a tribological standpoint. Based on the salt-type basic structure of the ionic liquids, lubricant additives such as antioxidants, antifriction agents, anticorrosion additives, antiwear agents, extreme pressure additives and the like are usually insoluble in ionic liquids. However, many tribological applications require ionic liquids to be provided with such additives to improve their properties. However, it is enormous technological expense to develop new additives, so for cost reasons it is also desirable for standard additives to be usable in ionic liquids.

Another disadvantage of the known lubricating grease compositions in use is the tendency to absorb water and/or react with water due to the ionic liquids. When anions such as sulfate, chloride, bromide or tetrafluoroborate are present in the ionic liquids, this usually results in water-soluble ionic liquids. In addition, tetrafluoroborate and hexafluorophosphate may form hydrofluoric acid under the influence of water, which may lead to a great tendency to corrosion. This is also the case when chloride is present.

Another disadvantage is that use of anions, which are referred to as hydrophobic, such as bis(trifluoromethylsulfonyl)imide, is not sufficient to provide greases with adequate water resistance from a tribological standpoint.

Furthermore, with the known lubricating grease compositions, the low-temperature properties of the ionic liquids used are not adequately taken into account. For example, JP 2003-376010 discloses ionic liquids that contain bis(trifluoromethyl-sulfonyl)imide and have N-alkylpyridinium cations or N,N'-dialkylimidazolium cations with a high tendency to form supercooled melts. For example, 1-ethyl-3-methylimidazolium bis(trifluoromethylsulfonyl)imide is an ionic liquid having a low viscosity and a strong propensity for supercooling, but the melting point which is relevant for tribological applications is −16° C. (low temperature DSC measurements). However, for many tribological applications, the additive must have good flow properties down to −30° C. or even less. Ionic liquids such as 1-ethyl-3-methylimidazolium bis(trifluoromethylsulfonyl)imide also have the disadvantage that they may spontaneously solidify at low temperatures, which can lead to failure of the component being lubricated.

Ionic liquids containing the anion tris(perfluoroethyl) trifluorophosphate, for example, usually have a lower water uptake capacity than ionic liquids using bis(trifluoromethylsulfonyl)imide as the anion, but the melting points are higher. Therefore, because of their low-temperature properties, these ILs that contain tris(perfluoroethyl)trifluorophosphate are not usually suitable for use as the sole base oil for lubricants having good low-temperature properties.

The object of the present invention is to provide a water-resistant oxidation-inhibiting and corrosion-inhibiting lubricating grease composition which can be used over a wide range of application temperatures.

This object is achieved by using a lubricating grease composition consisting of an ionic liquid as the base oil, suitable standard additives and thickeners. By using ionic liquids in which the hydrophobic anions are combined with cations having a high hydrocarbon group content, excellent anticorrosion properties and an excellent water resistance are achieved.

This combination achieves the result that standard additives are soluble in the ionic liquid. The high hydrocarbon group content reduces the resistance to oxidation, so antioxidants may be added as a countermeasure. Use of standard antioxidants increases the thermal stability and oxidation stability of the lubricating grease composition. In addition, it has surprisingly been found that the greases remain in a good lubricating condition in lifetime tests despite the high level of oxidation of the ionic liquid in some cases. As found in low-temperature DSC experiments, the ionic liquids used according to the present invention do not have melting points, glass transition temperatures or other phase transitions above a temperature of −30° C., which would lead to a great increase in the viscosity of the ionic liquid.

These ionic liquids which are used in the lubricating grease composition include the ionic liquids that contain a quaternary ammonium cation or a phosphonium cation as the cation, which is combined with an anion containing fluorine selected from the group consisting of bis(perfluoroalkylsulfonyl)imide, in particular bis(trifluoromethylsulfonyl)imide and tris(perfluoroalkyl)methidene. In the anions listed above, individual fluorine atoms may be exchanged for hydrogen. The cations have a sufficiently long hydrophobic alkyl chain, aryl group or alkylaryl group with at least 8 to 25 carbon atoms, where the number of such hydrophobizing groups of the cation must include at least 15 to 60 carbon atoms. Comparable apolar groups such as aryl groups or alkylated aryl groups are also conceivable. In addition, the ionic liquids used according to the present invention do not have any phase transitions that affect viscosity down to temperatures below −40° C. This is achieved by, among other things, the fact that the cations have a low symmetry, i.e., long and short substituents are combined.

Ionic liquids having highly fluorinated anions are especially preferred because they usually have a high thermal stability. The ability to uptake water may also be definitely reduced by such anions, for example, in the case of bis(trifluoromethylsulfonyl)imide anion.

The inventive lubricating grease compositions may contain a single ionic liquid or a mixture of two or more ionic liquids, in which case the second ionic liquid need not necessarily be water resistant. The quantitative distribution of the ionic liquids used is in the range of at least 75% to 95% of the first long-chain ionic liquid to 5% to 25% of the second ionic liquid. The second ionic liquid is advantageously selected from the group consisting of ionic liquids, comprising fluorinated anions such as, for example, bis(fluoroalkylsulfonyl) imides, in particular bis(trifluoro-methylsulfonyl)imide, bis (fluoroaryl)imide, tris(perfluoroalkyl)triphosphate and fluorinated alkylsulfonates with any cations or, alternatively, ionic liquids having any anions but with the long-chain cations described above.

Furthermore, the lubricating grease compositions used according to the invention contain the usual additives or additive mixtures selected from anticorrosion agents such as oxalines, thiazoles, succinic acid hemiesters, zinc carboxylates, sodium sulfonates, calcium sulfonates, barium sulfonates, antioxidants, such as aromatic amines, aromatic phenols, phosphites, sulfur compounds such as dialkyl dithiophosphates, antiwear agents and extreme pressure additives such as compounds containing phosphorus and sulfur, e.g., zinc dialkyl dithiophosphate, sulfurized fatty acids and fatty acid esters, dialkyl sulfide and dialkyl oligosulfides and polysulfides, boric acid esters, friction reducing agents such as glycerol monoesters and diesters, agents to protect against the effects of metals used as chelating compounds, radical scavengers, UV stabilizers, reactive layer-forming agents, viscosity improvers such as polyisobutylene, polymethacrylate as well as organic and inorganic solid lubricants, e.g., polyimide, polytetrafluoroethylene (PTFE), graphite, metal oxides, boron nitride, molybdenum disulfide and phosphate.

The thickeners used include PTFE, bentonite, aerosols, water-insoluble carboxylic acid salts and mixtures thereof, water-insoluble sulfonic acid salts and mixtures thereof, ureas, carbon blacks, graphites, metal oxides such as titanium oxide and zinc oxide and mixtures thereof.

In particular, additives in the form of compounds containing phosphorus and sulfur, e.g., zinc dialkyl dithiophosphate, dithiocarbamates, sulfurized hydrocarbons and fatty acids, phosphorus and sulfur-free substances, e.g., boric acid esters as antiwear agents and friction reducing agents; metal salts, esters, phenols, nitrogen-containing compounds such as aromatic amines, aromatic heterocyclic compounds, sulfonate salts, organic acids and salts are used as agents to prevent corrosion, glycerol monoesters or diesters are used as friction reducing agents and polyisobutylene, polymethacrylate are used as viscosity improvers.

The water-resistant lubricant compositions used according to the present invention contain:

(a) 40 to 95 wt % ionic liquid, (b) 5 to 60 wt % water-resistant thickener and (c) 0.1 to 10 wt % additive.

The inventive lubricating grease composition preferably contains 60 to 90 wt % ionic liquid, 10 to 40 wt % water-resistant thickeners and 0.1 to 10 wt % additives.

The cation of the ionic liquid is selected from the group consisting of a quaternary ammonium cation or a phosphonium cation, and the anion is selected from the group consisting of a bis(perfluoroalkylsulfonyl)imide, in particular bis (trifluoro-methyl-sulfonyl)imide, bis(perfluoroaryl)imide, tris(perfluoroalkyl)triphosphate, where the cation of the ionic liquid has a long hydrophobic alkyl chain, aryl group or alkylaryl group with at least 8 to 25 carbon atoms, and all the hydrophobizing alkyl, aryl or alkylaryl groups of the cation have at least 15 to 60 carbon atoms and have a melting point of ≦30° C. Preferred additives include aminic and phenolic antioxidants, anticorrosion additives such as amine phosphates, heterocyclic compounds, succinic acid hemiesters, zinc dialkyl dithiophosphates and extreme pressure/antiwear additives such as substances containing phosphorus and/or sulfur.

By using ionic liquids, the inventive lubricant compositions can be used at high temperatures of at least 180° C., but due to the reduction in the electric resistance of the oils, they may also be used in areas where the flow of electric current has repeatedly led to damage due to electric breakdowns, e.g., in railroad wheel bearings, roller bearings through which an electric current passes, in the automotive field or in electric motors.

An especially preferred ionic liquid is trihexyltetradecylphosphonium bis(trifluoromethylsulfonyl)imide, hereinafter referred to as HDPimide, which is represented by the following formula (I):

Formula (I)

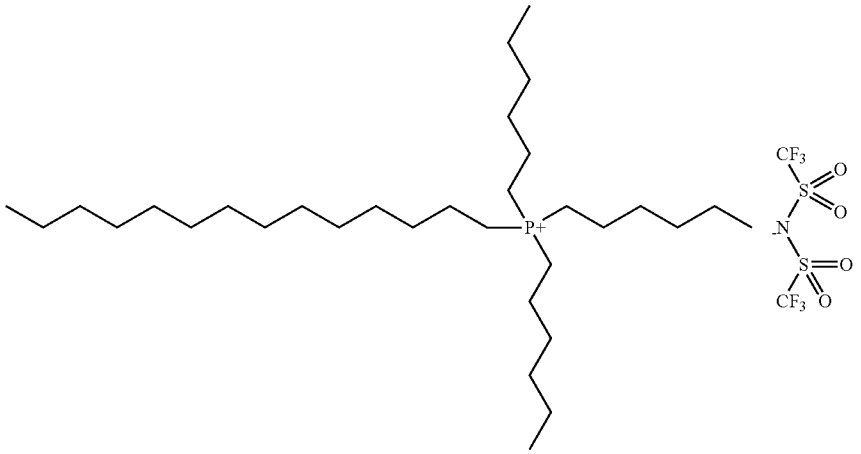

The advantages of the inventive lubricating grease composition are explained now on the basis of the following examples.

EXAMPLES

Two ionic liquids and their grease formulations are compared below.

The lubricating grease composition according to the present invention contains trihexyltetradecylphosphonium bis(trifluoromethylsulfonyl)imide as the ionic liquid.

In a comparative example, a lubricating grease composition contains an ionic liquid having the identical anion, which is referred to as butylmethylpyrrolidinium bis(trifluoromethylsulfonyl)imide, hereinafter referred to as MBPimide, which is represented by the following formula (II):

Formula (II)

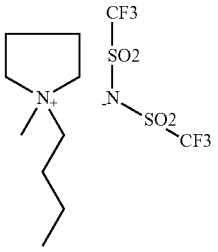

Bis(trifluoromethylsulfonyl)imide is classified with the hydrophobic anions. In contrast with HDPimide, MBPimide does not have any long alkyl chains.

MBPimide can remain liquid with simple cooling down to temperatures of −40° C., but the melting point determined according to DSC is −6° C. MBPimide thus has a strong tendency to form a supercooled melt.

On the basis of another ionic liquid, which is known as methyltrioctylammonium bis(trifluoromethylsulfonyl) imide, hereinafter referred to a Moimide, which has an ammonium cation and long hydrocarbon chains, it is additionally demonstrated that the advantageous properties of the lubricating grease composition are not limited to the use of phosphonium cations but instead can also be achieved with ammonium cations. This compound is represented by the following formula (III)

Formula (III)

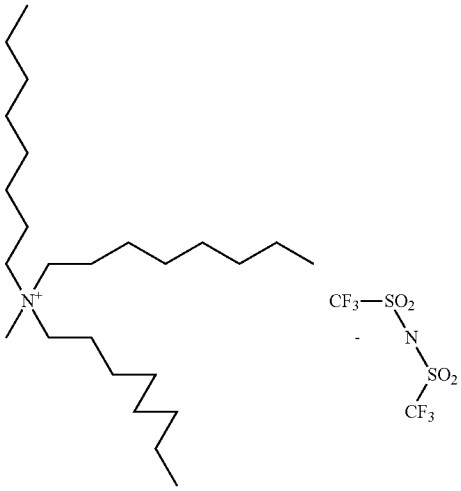

Table 1 summarizes the physical data on these three compounds.

TABLE 1

| | HDPimide | MBPimide | Moimide |
|---|---|---|---|
| V 20 ($mm^2$/sec) | — | — | 640 |
| V 40 ($mm^2$/sec) | 139.62 | 30.7 | — |
| V 100 ($mm^2$/sec) | 17.2 | 6.47 | — |
| VI | 135 | 171 | — |
| Density 15° C. (g/mL) | 1.0724 | 1.4076 | — |
| Density 20° C. (g/mL) | — | — | 1.109 |
| Melting point (DSC) | −69° C. | −6° C. | −50° C. |
| Onset of oxidation DSC, pure oxygen 1 k/min | 168° C. | >200° C.* | 163° C. |

*An initial slight oxidation starts slightly above 200° C. but a more pronounced oxidation begins only above approx. 240° C.

Example 1

Water Resistance According to DIN 51807, Part 1, of Greases Based on MBPimide and HDPimide in Comparison The two ILs are thickened with PTFE powder to yield the consistency of a grease (stirring, rolling) and tested at 3 h/90°

C. according to DIN 51807, Part 1. The grease sample containing HDPimide does not show any signs of dissolution or separation and is graded as 0 (=very good).

The grease sample containing MBPimide shows dissolution of the strip. After cooling the water test medium, turbidity is observed, attributable to partial dissolution of the MBPimide at high temperatures. This test is therefore graded as 3 (=poor).

Example 2

Solubility of Standard Additives in MBPimide and HDPimide

The following three anticorrosion additives were tested for their solubility in the aforementioned ILs:

A succinic acid hemiester, an oxazoline derivative and an acetic acid derivative. All substances are up to 1% soluble at room temperature in HDPimide. Only the oxazoline derivative will dissolve in MBPimide after being heated to approx. 150° C., but it separates out again on cooling.

Example 3

Efficacy of Standard Additives in HDPimide on the Example of an Antioxidant

1% of a p,p'-dialkyldiphenylamine is dissolved as an antioxidant in HDPimide. The mixture remains clear even after standing for several hours at room temperature. In a DSC run under oxygen under the conditions listed in Table 1, the onset of oxidation is at 223° C. There is thus an increase of 55° C. when this value is compared with HDPimide without additive.

Example 4

Efficacy of a Lubricating Grease Composition Based on HDPimide

The usual additives are dissolved in HDPimide to improve the anticorrosion properties and the oxidation stability. These include an anticorrosion additive that contains zinc and an aminic antioxidant. In addition, an insoluble anticorrosion pigment containing zinc is also used. This mixture is thickened with PTFE powder by the usual methods to yield the consistency of a grease. This mixture supplied the test results shown in Table 2:

TABLE 2

| | |
|---|---|
| Lubricating grease composition | HDPimide (approx. 65%)<br>PTFE powder (approx. 32%)<br>Additive (approx. 3%) |
| Penetration ¼ cone, DIN ISO 2137 | Resting 73, milling 60 DT 73 |
| Pour point DIN ISO 2176 | >300° C. |
| Oil separation 30 hours at 150° C. (FTMS 791 C 321) | 2.2% |
| Apparent dynamic viscosity at 300 $sec^{-1}$ after 60 sec | 3200 mPas |
| Loss on evaporation according to DIN 58397, Part 1 | 100 h/150° C. 1.44%<br>24 h/200° C. 2.1% |
| Low-temperature torque according to ASTM D 1478 | −30° C. start 53 Nmm, run 27 Nmm<br>−35° C. start 53 Nmm, run 53 Nmm |
| Flow pressure at −40° C. DIN 51805 | 175 mbar |
| Emcor, distilled water DIN ISO 51802 | 0 |
| Copper corrosion 24 h/150° C.; DIN 51811 | 1 |
| Welding force DIN 51350 part 4 | 5500N |
| Shell roll test 50 h/80° C. based on ASTM D 1831 | +56 units |
| FEG FE 9, 180° C., 6000 rpm, 1500N, installation A DIN 51821 | L 10 > 300 h<br>L 50 > 400 h |
| FEG FE 9, 200° C., 6000 rpm, 1500N, installation A DIN 51821 | L 10 = 92 h<br>L 50 = 101 h |
| Water resistance, DIN 51807 Part 1, 3 h/90° C. | 0 |
| Water resistance DIN 51807 Part 2, 1 h/80° C. | Loss 2% |

Table 2 shows that the inventive lubricating grease composition achieves good high- and low-temperature properties, good anticorrosion properties for steel and copper with a water resistance in both dynamic and static experiments.

A water resistance test was conducted in accordance with DIN 51807, Part 2, using the lubricating grease composition specified above according to the present invention, with the result that the grease adhered to the bearing very well.

Example 5

Water-Resistant Grease Formulation with an Ammonium Cation

Moimide is thickened to the consistency of grease using PTFE by the usual methods, yielding the test results shown in Table 3.

TABLE 3

| | |
|---|---|
| Lubricating grease composition | Moimide<br>PTFE powder |
| Penetration ¼ cone, DIN ISO 2137 | 59 |
| Water resistance DIN 51807 Part 1, 3 h/90° C. | 0 |
| Water resistance DIN 51807 Part 2, 1 h/80° C. | Loss 2.25% |

Table 3 shows that ionic liquids containing not only phosphonium as the cation but also ammonium yield formulations that are water resistant.

Another advantage of the lubricating grease compositions according to the present invention using the ionic liquids specified here thus consists of the reduced density due to the presence of the hydrocarbon groups, which leads to a lower price per unit of volume of lubricant and thus to lower costs per component to be lubricated.

Example 6

Behavior of Mixtures of Ionic Liquids with Respect to Water Resistance

Mixtures having different contents with regard to the ILs are prepared from HDPimide and MBPimide. The mixtures are thickened with approx. 30% PTFE powder and homogenized by rolling to yield fats having a penetration that would correspond to a consistency degree of 2. The fats are tested with regard to their static water resistance and in some cases with respect to dynamic water resistance. The results are shown in Table 4.

TABLE 4

| Sample | 1 | 2 | 3 | 4 | 5 |
|---|---|---|---|---|---|
| MBPimide to HDPimide ratio approx. | 9:1 | 3:1 | 1:1 | 1:3 | 1:9 |
| Water resistance, DIN 51807 Part 1, 3 h/90° C. | 2 | 2 | 2 | 2 | 0 |
| Water resistance DIN 51807 Part 2, 1 h/80° C., weight loss | not determined | not determined | 45% | 6.5% | 9% |

Weight loss values up to 10% are graded as 1 = very good in the water resistance test according to DIN 51807 Part 2. Results with losses greater than 30% are graded as 3 (poor stability).

Table 4 shows that a lubricating grease composition is possible according to the present invention, using a combination of ionic liquids and having an inadequate water resistance from a tribological standpoint, such as MBPimide. In the present example, at least 10% of the inadequately hydrophobic IL MBPimide can be used, based on the base oil content, while preserving the very good water resistance. A partial water resistance is obtained even with up to 25% base oil content. A mixture of equal parts of the ionic liquids no longer has water resistance. The critical and/or acceptable mixing ratios depend on the ionic liquids used and therefore cannot be generalized.

Example 7

In this formulation 89% HDPimide is mixed with 10% lithium 12-hydroxystearate (soap thickener) and introduced into the melt. After cooling, 1% of a conventional aminic antioxidant is added. The mixture is homogenized by intense rolling several times using a roll mill.

TABLE 5

| | |
|---|---|
| Lubricating grease composition | HDPimide (89%)<br>Lithium 12-hydroxystearate (10%)<br>Antioxidant (1%) |
| Penetration ¼ cone, DIN ISO 2137 | Milling 60 DT 82 |
| Pour point DIN ISO 216 | 200° C. |
| Oil separation 30 h/150° C. (FTMS 791 C 321) | 6.32% |
| Oil separation, 168 h/40° C. (DIN 51807) | 4.88% |
| Loss on evaporation according to DIN 58397 Part 1 | 24 h/150° C. 0.9% |
| Water resistance DIN 51807 Part 1, 3 h/90° C. | 0 |
| Water resistance DIN 51807 Part 2, 1 h/80° C. | Loss 5% |

Example 8

Cyclohexylamine and bis(paraisocyantophenyl)methane (MDI) are dissolved in separate portions of HPDimide in a molar ratio of 2:1 and the solutions are reacted by combining them. After heating to 180° C. and then cooling, 1% of a typical aminic antioxidant is added and the grease is homogenized by rolling using a roll mill.

TABLE 6

| | |
|---|---|
| Lubricating grease composition | HDPimide (84%)<br>Urea thickener (15%)<br>Antioxidant (1%) |
| Penetration ¼ cone, DIN ISO 2137 | Milling 60 DT 73 |
| Pour point DIN ISO 216 | 291° C. |
| Oil separation 30 h/150° C. (FTMS 791 C 321) | 1.22% |
| Oil separation 168 h/40° C. (DIN 51807) | 1.57% |

TABLE 6-continued

| | |
|---|---|
| Loss on evaporation according to DIN 58397 Part 1 | 24 h/150° C. 1.46% |
| Water resistance DIN 51807 Part 1, 3 h/90° C. | 0 |

Examples 7 and 8 show that by using an ionic liquid together with either a urea thickener or a soap thickener, it is possible to obtain formulations that have water resistance and can be applied as a protective film to a wide variety of materials to form corrosion resistant and oxidation resistant layers, and to impart stable water resistance to these materials. This lubricating grease composition is also necessary in particular in applications in the automotive field, in water pump bearings, wheel bearings, articulated shafts, clutch release bearings, central bearings (center bearing), axial bearings in the strut, electromechanical brakes, fan bearings, miniature bearings, exhaust gas recirculation systems, generator bearings, windshield wipers and the like, in order to ensure that oxidation or corrosion of the coated surfaces will be prevented during operation. Furthermore, the water-resistant lubricating grease composition may also be used in wind power plants, main bearings, generator bearings, blade bearings, azimuth bearings as well as all components and surfaces which are exposed to constant contact with water.

The invention claimed is:

1. A method for protective treatment of a component exposed to contact with water to prevent corrosion and oxidation at temperatures of at least −30° C. to at least 180° C. comprising applying a water-resistant lubrication grease composition to the surface of the component to be treated, the water-resistant lubrication grease composition comprising:

(a) 40 to 95 wt. % of one or more ionic liquid(s) having a cation selected from the group consisting of a quaternary ammonium cation or a phosphonium cation and having an anion selected from the group consisting of a bis(perfluoroalkylsulfonyl)imide, bis(trifluoromethylsulfonyl)imide, bis(perfluoroaryl)imide, and tris(perfluoroalkyl)trifluorophosphate, wherein the cation of the ionic liquid has a long hydrophobic alkyl chain, aryl group or alkylaryl group with at least 8 to 25 carbon atoms and all the hydrophobizing alkyl, aryl or alkyaryl groups of the cation have at least 15 to 60 carbon atoms and a melting point of <−30° C.;

(b) 0.1 to 10 wt. % of a conventional soluble additive for lubricants;

(c) 5 to 60 wt. % of a water-resistant thickener.

2. The method of claim 1, wherein the one or more ionic liquid(s) of the lubrication grease composition comprises a compound selected from the group consisting of trihexyltetradecyiphosphonium bis(trifluoromethylsulfonyl)imide (HDPimide), methyltrioctylammonium bis(trifluoromethylsulfonyl)imide (Moimide), and trihexyltetradecylphosphonium tris(perfluoroethyl).

3. The method of claim 1, wherein component (a) of the lubrication grease composition comprises one ionic liquid or a mixture of two or more ionic liquids, wherein the second ionic liquid need not necessarily be water resistant.

4. The method of claim 3, wherein the ratio of the mixture of the first ionic liquid to the second ionic liquid is in the range of 75 to 95% to 5 to 25%.

5. The method of claim 3, wherein the second ionic liquid has a fluorinated anion selected from the group consisting of bis(trifluoromethylsulfonyl)imide, bis(fluoroaryl) imide, tris(per-fluoroalkyl)triphosphate and fluorinated alkyl sulfonate combined with any cation;

or a long-chain cation selected from the group consisting of a quaternary ammonium cation and a phosphonium cation and combined with any anion.

6. The method of claim 1, wherein the additive is selected from the group consisting of an anti-corrosion agent, antioxidant, anti-wear agent, extreme pressure additive, friction reducing agent, agent to protect against metal influences, UV stabilizer, an organic or inorganic solid lubricant selected from polyimide, polytetrafluoroethylene (PTFE), graphite, metal oxides, boron nitride, molybdenum disulfide and phosphate.

7. The method of claim 6, wherein the antioxidant is selected from the group consisting of aromatic amines, phenols, and sulphur-containing substances.

8. The method of claim 6, wherein the anti-corrosion agent is selected from the group consisting of aromatic heterocyclic compounds, sulfonate salts, organic acids, and organic salts.

9. The method of claim 6, wherein the anti-wear agent, extreme pressure additive and friction-reducing agent is selected from the group consisting of phosphates, sulphur-containing compounds, phosphorous- and sulphur-containing compounds, boron-containing compounds, and heterocyclic compounds.

10. The method of claim 1, wherein the thickener of the lubricating grease composition is selected from PTFE, bentonite, aerosol, water-insoluble carboxylic acid salts and/or mixtures thereof, water-insoluble sulphonic acid salts and mixtures thereof, urea, carbon black, graphite, and metal oxides such as titanium oxide, zinc oxide and/or mixtures thereof.

11. The method of claim 1, wherein the lubricating grease composition comprises as the one or more ionic liquid(s) a compound of a trialkyl tetradecylphosphonium cation and highly fluorinated anions.

12. The method of claim 1, wherein the component is selected from automotive parts, parts in wind power plant, in processing and working machines as well as in household articles to protect them from oxidation and corrosion.

13. A water-resistant lubricating grease composition comprising:

(a) 40 to 95 wt. % of one or more ionic liquid(s) having a cation selected from the group consisting of a quaternary ammonium cation or a phosphonium cation and having an anion selected from the group consisting of a bis (perfluoroalkylsulfonyl)imide, bis(trifluoromethylsulfonyl)imide, bis(perfluoroaryl)imide, and tris(perfluoroalkyl)trifluorophosphate, wherein the cation of the ionic liquid has a long hydrophobic alkyl chain, aryl group or alkylaryl group with at least 8 to 25 carbon atoms and all the hydrophobizing alkyl, aryl or alkyaryl groups of the cation have at least 15 to 60 carbon atoms and a melting point of <−30° C.;

(b) 0.1 to 10 wt. % of a conventional soluble additive; and (c) 5 to 60 wt. % of a water-resistant thickener.

14. The water-resistant lubricating grease composition according to claim 13, wherein the one or more ionic liquid(s) comprises a compound selected from the group consisting of trihexyltetradecylphosphonium bis(trifluoromethylsulfonyl) imide (HDPimide), methyltrioctylammonium bis(trifluoromethylsulfonyl)imide (Moimide), and trihexyltetradecylphosphonium tris(perfluoroethyl).

15. The water-resistant lubricating grease composition according to claim 13, wherein the lubrication grease composition comprises one ionic liquid or a mixture of two or more ionic liquids, wherein the second ionic liquid need not necessarily be water resistant.

16. The water-resistant lubricating grease composition according to claim 15, wherein the ratio of the mixture of the first ionic liquid to the second ionic liquid is in the range of 75 to 95% to 5 to 25%.

17. The water-resistant lubricating grease composition according to claim 15, wherein the second ionic liquid has a fluorinated anion selected from the group consisting of a bis(trifluoromethylsulfonyl)imide, bis(fluoroaryl) imide, and fluorinated alkyl sulfonate combined with any cation;

or a long-chain cation selected from the group consisting of a quaternary ammonium cation and a phosphonium cation and combined with any anion.

18. The water-resistant lubricating grease composition according to claim 13, wherein the additive is selected from the group consisting of an anti-corrosion agent, antioxidant, anti-wear agent, extreme pressure additive, friction reducing agent, agent to protect against metal influences, UV stabilizer, an organic or inorganic solid lubricant selected from polyimide, polytetrafluoroethylene (PTFE), graphite, metal oxides, boron nitride, molybdenum disulfide and phosphate.

19. The water-resistant lubricating grease composition according to claim 18, wherein the antioxidant is selected from the group consisting of aromatic amines, phenols, and sulphur-containing substances.

20. The water-resistant lubricating grease composition according to claim 18, wherein the anti-corrosion agent is selected from the group consisting of aromatic heterocyclic compounds, sulfonate salts, organic acids, and organic salts.

21. The water-resistant lubricating grease composition according to claim 18, wherein the anti-wear agent, extreme pressure additive and friction-reducing agent is selected from the group consisting of phosphates, sulphur-containing compounds, phosphorous- and sulphur-containing compounds, boron-containing compounds, and heterocyclic compounds.

22. The water-resistant lubricating grease composition according to claim 13, wherein the thickener of the lubricating grease composition is selected from PTFE, bentonite, aerosol, water-insoluble carboxylic acid salts and/or mixtures thereof, water-insoluble sulphonic acid salts and mixtures thereof, urea, carbon black, graphite, and metal oxides such as titanium oxide, zinc oxide and/or mixtures thereof.

23. The water-resistant lubricating grease composition according to claim 13, wherein the lubricating grease composition comprises as the one or more ionic liquid(s) a compound of a trialkyl tetradecylphosphonium cation and highly fluorinated anions.

* * * * *